US011274377B2

(12) United States Patent
Hanson et al.

(10) Patent No.: US 11,274,377 B2
(45) Date of Patent: Mar. 15, 2022

(54) SEAL APPARATUS FOR AN ELECTROPLATING SYSTEM

(71) Applicant: Applied Materials, Inc., Santa Clara, CA (US)

(72) Inventors: Kyle M. Hanson, Kalispell, MT (US); Manjunatha Vishwanatha Adagoor, Bengaluru (IN); Karthikeyan Balaraman, Bangalore (IN); Karthick Vasu, Bangalore (IN); Shailesh Chouriya, Bengaluru (IN)

(73) Assignee: Applied Materials, Inc., Santa Clara, CA (US)

( * ) Notice: Subject to any disclaimer, the term of this patent is extended or adjusted under 35 U.S.C. 154(b) by 135 days.

(21) Appl. No.: 16/386,456

(22) Filed: Apr. 17, 2019

(65) Prior Publication Data

US 2019/0323141 A1 Oct. 24, 2019

Related U.S. Application Data

(60) Provisional application No. 62/660,436, filed on Apr. 20, 2018.

(51) Int. Cl.
*C25D 17/00* (2006.01)
*C25D 17/06* (2006.01)

(52) U.S. Cl.
CPC ..... *C25D 17/004* (2013.01); *C25D 17/001* (2013.01); *C25D 17/005* (2013.01); *C25D 17/06* (2013.01)

(58) Field of Classification Search
None
See application file for complete search history.

(56) References Cited

U.S. PATENT DOCUMENTS 6,080,291 A * 6/2000 Woodruff ..... C25D 17/001 204/212
2002/0144900 A1* 10/2002 Keigler ..... C25D 17/001 204/297.05

(Continued)

FOREIGN PATENT DOCUMENTS

WO 2013148890 A1 10/2013
WO WO2016198219 * 12/2016 ..... B65D 47/28

OTHER PUBLICATIONS

International Preliminary Report on Patentability dated Oct. 20, 2020 in International Patent Application No. PCT/US2019/027979, 5 pages.

(Continued)

*Primary Examiner* — Stefanie S Wittenberg
(74) *Attorney, Agent, or Firm* — Kilpatrick Townsend & Stockton LLP

(57) ABSTRACT

Electroplating system seals may include an annular busbar characterized by an inner annular radius and an outer annular radius. The annular busbar may include a plurality of contact extensions. The seals may include an external seal member characterized by an inner annular radius and an outer annular radius. The external seal member may be vertically aligned with and extend inward of the contact extensions at the inner annular radius of the external seal member. The external seal member may include an interior surface at least partially facing the contact extensions. The seals may also include an internal seal member extending a first distance along the interior surface of the external seal member from the inner annular radius. The internal seal member may include a deformable material configured to support a substrate between the internal seal member and the plurality of contact extensions.

14 Claims, 3 Drawing Sheets

(56) References Cited

U.S. PATENT DOCUMENTS

| | | | | |
|---|---|---|---|---|
| 2007/0012251 | A1 | 7/2007 | Zucker et al. | |
| 2010/0155254 | A1 | 6/2010 | Prabhakar et al. | |
| 2010/0288639 | A1* | 11/2010 | Wang | G03G 17/04 204/483 |
| 2011/0181000 | A1 | 7/2011 | Ghongadi et al. | |
| 2015/0068890 | A1* | 3/2015 | Yoshioka | C25D 17/06 204/297.01 |
| 2016/0102410 | A1* | 4/2016 | Speidel | H01M 8/0247 429/434 |
| 2017/0009367 | A1 | 1/2017 | Harris et al. | |

OTHER PUBLICATIONS

International Search Report and Written Opinion dated Aug. 2, 2019 in International Patent Application No. PCT/US2019/027979, all pages.

* cited by examiner

SEAL APPARATUS FOR AN ELECTROPLATING SYSTEM

CROSS-REFERENCES TO RELATED APPLICATIONS

This application claims the benefit of U.S. Provisional Patent Application No. 62/660,436, filed on Apr. 20, 2018, and which is hereby incorporated by reference in its entirety for all purposes.

TECHNICAL FIELD

The present technology relates to electroplating systems. More specifically, the present technology relates to system seals that may be used to support a substrate during electroplating operations.

BACKGROUND

Integrated circuits are made possible by processes which produce intricately patterned material layers on substrate surfaces. After formation, etching, and other processing on a substrate, metal or other conductive materials are often deposited or formed to provide the electrical connections between components. Because this metallization may be performed after many manufacturing operations, problems caused during the metallization may create expensive waste substrates or wafers.

During formation of metal materials on a wafer or substrate, a wafer may be submerged within a plating bath followed by metal formation on the wafer. The wafer may be held in place on an apparatus that submerges the wafer in a plating bath of electrolyte. The apparatus holding the wafer may include electrically conductive components contacting the wafer, allowing the wafer to operate as a cathode in the plating operation. Because the apparatus and electrical contacts may similarly be submerged within the plating bath, the apparatus may include a seal or multiple components operating as a seal to limit or prevent the electrolyte from contacting internal conductive components. These seal materials may include complex machined parts and specialized materials that may be relatively expensive.

Thus, there is a need for improved systems and components that can be used to support a substrate during electroplating operations. These and other needs are addressed by the present technology.

SUMMARY

Electroplating system seals may include an annular busbar characterized by an inner annular radius and an outer annular radius. The annular busbar may include a plurality of contact extensions disposed along the inner annular radius. The seals may include an external seal member characterized by an inner annular radius and an outer annular radius. The external seal member may be vertically aligned with and extend inward of the contact extensions at the inner annular radius of the external seal member. The external seal member may include an interior surface at least partially facing the contact extensions, an exterior surface opposite the interior surface, and an inner sidewall extending between the interior surface and the exterior surface at the inner annular radius. The seals may also include an internal seal member extending a first distance along the interior surface of the external seal member from the inner annular radius. The internal seal member may include a deformable material configured to support a substrate between the internal seal member and the plurality of contact extensions.

In some embodiments, the external seal member may be or include a thermoplastic polymer, and the internal seal member may be or include a thermoplastic elastomer. An interface of the external seal member and the internal seal member may be a preformed interphase of the thermoplastic polymer and the thermoplastic elastomer. The external seal member may be a glass-filled polypropylene. The internal seal member may be thermoplastic vulcanizate or styrene ethylene butylene styrene. The internal seal member may extend inward of the external seal member, and the internal seal member may extend vertically along the inner sidewall of the external seal member at the inner annular radius of the external seal member. The external seal member may be maintained substantially free of the internal seal member along the exterior surface of the external seal member. The external seal member may define a recessed ledge along the exterior surface between the inner annular radius and the outer annular radius of the external seal member. An additional amount of the deformable material of the internal seal member may be positioned along the recessed ledge.

The present technology may also encompass electroplating system seals. The seals may include an external seal member characterized by an inner annular radius and an outer annular radius. The external seal member may include an interior surface, an exterior surface opposite the interior surface, and an inner sidewall extending between the interior surface and the exterior surface at the inner annular radius. The seals may include an internal seal member extending a first distance along the interior surface of the external seal member from the inner annular radius. An interface between the internal seal member and the external seal member may include an adhesive-free coupling between the external seal member and the internal seal member. An interface of the external seal member and the internal seal member may include a preformed interphase of the external seal member and the internal seal member. The external seal member may be or include a glass-filled polypropylene. The internal seal member may be or include thermoplastic vulcanizate or styrene ethylene butylene styrene.

In some embodiments the internal seal member may extend inward of the external seal member. The internal seal member may extend vertically along the inner sidewall of the external seal member at the inner annular radius of the external seal member. The external seal member may be maintained substantially free of the internal seal member along the exterior surface of the external seal member. The external seal member may define a recessed ledge along the exterior surface between the inner annular radius and the outer annular radius of the external seal member. An additional amount of material of the internal seal member may be positioned along the recessed ledge. The internal seal member may be characterized by a taper of material from the inner annular radius of the external seal member along the interior surface of the external seal member. The external seal member may define a partitioned channel extending radially about the external seal member and defined within the interior surface between the inner annular radius and the outer annular radius of the external seal member. The internal seal member may be characterized by a Shore A hardness of between about 30A and about 80A.

The present technology may also encompass electroplating system seals including an annular busbar characterized by an inner annular radius and an outer annular radius. The annular busbar may include a plurality of contact extensions disposed along the inner annular radius. The annular busbar may include an outer sidewall at the outer annular radius. The seals may include an external seal member characterized by an inner annular radius and an outer annular radius. The external seal member may include a thermoplastic polymer, and a portion of the external seal member may be vertically aligned with and extend inward of the contact extensions at the inner annular radius of the external seal member. The external seal member may include an interior surface at least partially facing the contact extensions, an exterior surface opposite the interior surface, and an inner sidewall extending between the interior surface and the exterior surface at the inner annular radius. The external seal member may extend outward of the annular busbar at the outer annular radius of the external seal member and vertically along the outer sidewall of the annular busbar. The seals may also include an internal seal member extending a first distance along the interior surface of the external seal member from the inner annular radius, wherein the internal seal member comprises a thermoplastic elastomer, and wherein the internal seal member is configured to support a substrate between the internal seal member and the plurality of contact extensions. In some embodiments, the external seal member may define a recessed ledge along the exterior surface between the inner annular radius and the outer annular radius of the external seal member. An additional amount of thermoplastic elastomer may be positioned along the recessed ledge.

Such technology may provide numerous benefits over conventional technology. For example, the present technology may reduce production and replacement costs compared to conventional designs. Additionally, the systems may limit or reduce contamination of electroplating baths due to a single seal location and the materials utilized in seals according to some embodiments of the present technology. These and other embodiments, along with many of their advantages and features, are described in more detail in conjunction with the below description and attached figures.

BRIEF DESCRIPTION OF THE DRAWINGS

A further understanding of the nature and advantages of the disclosed embodiments may be realized by reference to the remaining portions of the specification and the drawings.

Figure 1:
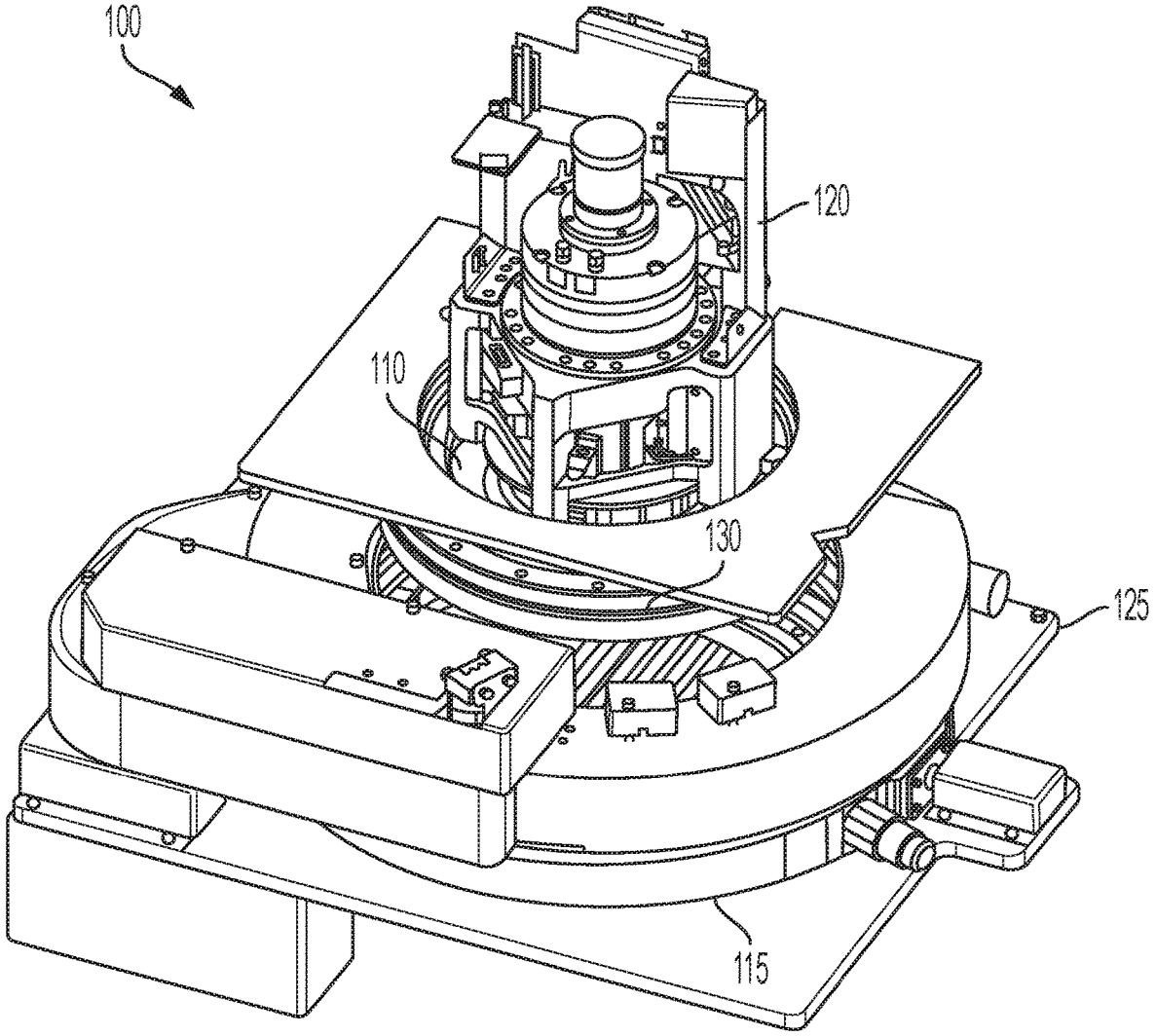
FIG. 1 shows a schematic perspective view of a chamber incorporating a seal apparatus according to some embodiments of the present technology.

Several of the figures are included as schematics. It is to be understood that the figures are for illustrative purposes, and are not to be considered of scale unless specifically stated to be of scale. Additionally, as schematics, the figures are provided to aid comprehension and may not include all aspects or information compared to realistic representations, and may include exaggerated material for illustrative purposes.

In the figures, similar components and/or features may have the same numerical reference label. Further, various components of the same type may be distinguished by following the reference label by a letter that distinguishes among the similar components and/or features. If only the first numerical reference label is used in the specification, the description is applicable to any one of the similar components and/or features having the same first numerical reference label irrespective of the letter suffix.

DETAILED DESCRIPTION

Various operations in semiconductor manufacturing and processing are performed to produce vast arrays of features across a substrate. As layers of semiconductors are formed, vias, trenches, and other pathways are produced within the structure. These features may then be filled with a conductive or metal material that allows electricity to conduct through the device from layer to layer.

Electroplating operations may be performed to provide conductive material into vias and other features on a substrate. Electroplating utilizes an electrolyte bath containing ions of the conductive material to electrochemically deposit the conductive material onto the substrate and into the features defined on the substrate. The substrate on which metal is being plated operates as the cathode. An electrical contact, such as a ring or pins, may allow the current to flow through the system. During electroplating, a substrate may be clamped to a head and submerged in the electroplating bath to form the metallization. In systems as described below, the substrate may also be chucked or seated within a seal that may be coupled with the head during processing. The seal may include one or more components that engages the substrate with the electrical contacts and may limit ingression of electrolyte into the head. For example, the seal may include a structural component as well as a flexible material that produces the seal against the substrate. As several of the components of the head may be electrically conductive and in electrical communication, if electrolyte contacts these components during a plating operation, plating or deposition may occur on these components as well.

Conventional technologies often use machined materials for the structural seal components, which may be robust and/or unreactive within the plating bath. Polyether ether ketone is a common material for structural rigidity. Metal materials, including stainless steel or titanium, may also be used for some of the structural head components, although stainless steel may require coating to limit introducing iron or other materials into the bath. Coatings on these materials as well as the elastomeric material may be or include fluorine-containing materials, such as fluoroelastomers, or other cross-linked elastomers, or thermosets, which may be robust and may be inert to the electrolyte bath. However, due to the properties of many conventional elastomeric components, an additional adhesive may be required to perform the actual coupling between the structural component and the elastomeric component. The combination of materials and difficult production may cause conventional seal materials to be expensive and time-intensive to fabricate.

The present technology overcomes these issues by utilizing less expensive materials that may not react with electrolytic baths, and may afford the removal of an adhesive to allow coupling of the elastomeric material with the structural material. After describing an exemplary chamber on which embodiments of the present technology may be used, the remaining disclosure will discuss aspects of the systems and processes of the present technology.

FIG. 1 shows a schematic perspective view of an electroplating system 100 for which methods and cleaning systems may be utilized and practiced according to embodiments of the present technology. Electroplating system 100 illustrates an exemplary electroplating system including a system head 110 and a bowl 115. During electroplating operations, a wafer may be clamped to the system head 110, inverted, and extended into bowl 115 to perform an electroplating operation. Electroplating system 100 may include a head lifter 120, which may be configured to both raise and rotate the head 110, or otherwise position the head within the system, including tilting operations. The head and bowl may be attached to a deck plate 125 or other structure that may be part of a larger system incorporating multiple electroplating systems 100, and which may share electrolyte and other materials. A rotor may allow a substrate clamped to the head to be rotated within the bowl, or outside the bowl in different operations. The rotor may include a contact ring, which may provide the conductive contact with the substrate. A seal 130 discussed further below may be connected with the head. Seal 130 may include a chucked wafer to be processed.

Figure 2:
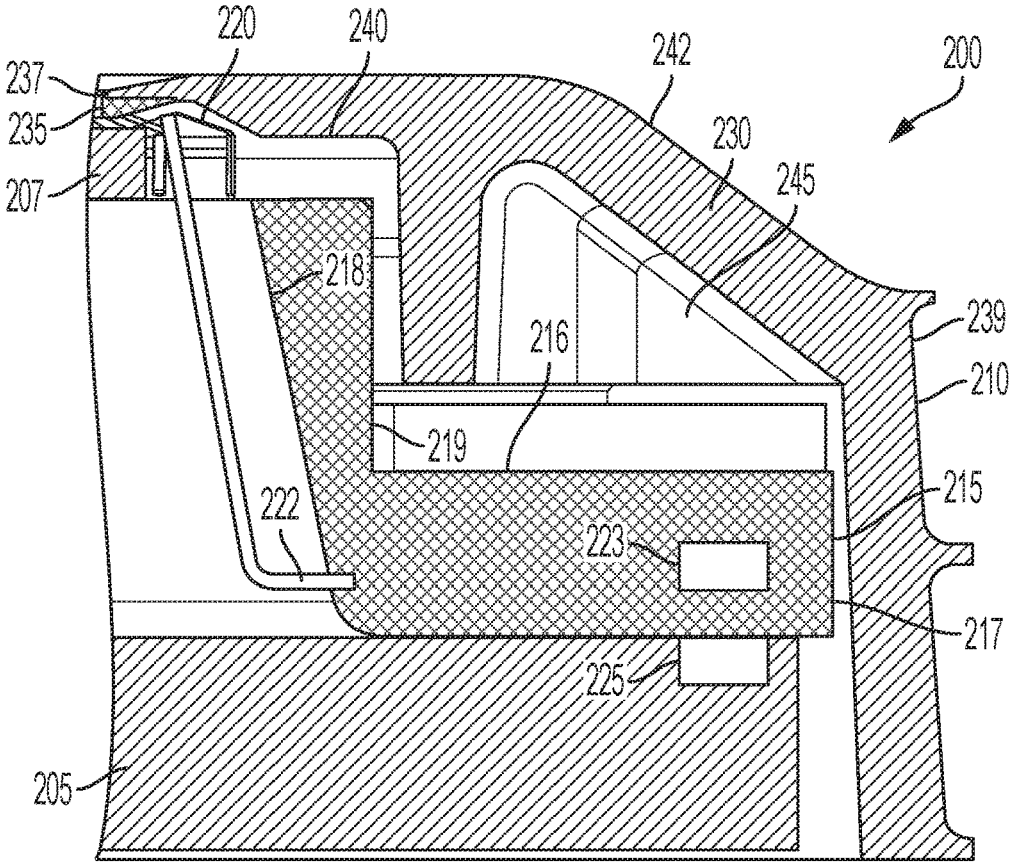
FIG. 2 shows a partial cross-sectional schematic view of an electroplating system seal according to some embodiments of the present technology.

FIG. 2 shows a partial cross-sectional schematic view of an electroplating system seal 200 according to some embodiments of the present technology. The figure may show a partial cross-section of seal 130 illustrated above. Seals according to the present technology may include multiple components that may be joined to produce the seal for supporting and holding a substrate during electroplating. A backing plate 205 may be a first structure of the seal, and may include a portion 207 on which a substrate may be positioned and engaged by the second structure of the seal. The backing plate 205 may also include a base to which the second structure of the seal may be coupled. The second structure of the system seal may include the seal member 210 as well as a busbar 215. In some embodiments the backing plate, busbar, and seal may all be coaxially aligned about a central axis extending vertically through the system seal 200.

Busbar 215 may be an annular component and may include one or more pieces connected together. The busbar may be characterized by an outer sidewall 217 at an outer annular radius of the component. The busbar 215 may also be characterized by an inner annular radius that may be defined by an inner sidewall 218 of the busbar, or by a component extending from the inner sidewall 218 of busbar 215. For example, busbar 215 may include a plurality of contact pins 220 disposed along the inner annular radius and extending inward from inner sidewall 218 towards the central axis. The contact pins 220 may be included in any spacing or orientation to provide uniform or directed contact to a substrate against which the electrical contacts are engaged. Although termed contact pins, contact pins 220 may be shaped in a variety of forms, and may be contact extensions or conductive extensions, which may include looped features in some embodiments to limit any piercing contact with a substrate. The contact pins may be coupled with or extend from an upper surface of the busbar 215 as illustrated in some embodiments.

Additionally, one or more support members 222 may extend from the inner sidewall 218, and extend past the upper surface of the busbar to interact with the contact pins 220. The support members 222 may be distributed radially about the busbar 215, and may be configured to facilitate centering and support of a substrate incorporated with the system seal 200. The busbar 215 may receive current through the contact pins 220 forming an electrode with the substrate, which may operate as the cathode on which a reduction reaction and electrical plating may occur. Busbar 215 may form a lateral base 216 proximate the outer annular radius, and with which the backing plate may be coupled. Busbar 215 may extend vertically towards the inner annular radius, and may form a neck 219 region towards the interior, which may define a frustum volume within the inner sidewall, although other cylindrical or geometric forms may similarly be formed.

The two or more components of the seal may be removably coupled in some embodiments allowing separation of the components for delivery and removal of a substrate. The coupling may occur by any number of means including mechanical coupling with bolts, screws, or other devices configured to join two components. The coupling may also be with magnets included within the busbar 215 and the backing plate 205. For example, a first plurality of magnets 223 may be disposed within busbar 215 and a second plurality of magnets 225 may be disposed within backing plate 205. When aligned, the magnets may attract one another and join the backing plate with the busbar. Overcoming the magnetic force of the magnets may afford decoupling of the two portions of the seal.

The seal member 210 of the overall structure may form an enclosure about the busbar and backing plate. The seal member 210 may be coupled with the busbar 215 in a number of ways, and may be bolted or otherwise mechanically coupled with the busbar. The coupling may include adhesive or other irreversible couplings, although in some embodiments the coupling may be a reversible coupling, such as with screws, bolts, or other mechanical fasteners, allowing the busbar 215 to be removed from seal member 210. Seal member 210 may include an external seal member 230 and an internal seal member 235 in some embodiments. The external seal member 230 and the internal seal member 235 may be bonded or coupled together to form seal member 210.

External seal member 230 may be an annular component extending about a central axis through the system seal 200. External seal member 230 may be characterized by an inner annular radius at an inner sidewall 237. External seal member 230 may also be characterized by an outer annular radius at an outer sidewall 239. Seal member 210, and specifically external seal member 230 may extend inward of and outward of each other component of system seal 200. For example, inner sidewall 237 may extend radially inward of the contact pins 220 at the inner annular radius of the external seal member 230. An inner portion of the external seal member 230 may also be vertically aligned with the contact pins 220, which may position internal seal member 235 in close proximity to contact pins 220 affording a more complete or fully complete seal with a substrate positioned between the internal seal member and the contact pins.

External seal member 230 may include a number of features and surfaces in embodiments. For example, external seal member 230 may include an interior surface 240 extending along a radial length of the external seal member 230 and defining a number of features of the external seal member 230. The interior surface 240 may be at least partially facing the contact pins 220, such as proximate an interior region of the external seal member 230. External seal member 230 may also include an exterior surface 242, which may be a surface opposite the interior surface 240 in some embodiments. At the inner annular radius, inner sidewall 237 may define a height between the interior surface 240 and the exterior surface 242 of the external seal member 230. In some embodiments, the inner sidewall 237 may be characterized by a height, which may correspond to a thickness of the external seal member 230 at an inner radius, of less than or about 1 cm, and in embodiments the height of inner sidewall 237 may be less than or about 9 mm, less than or about 8 mm, less than or about 7 mm, less than or about 6 mm, less than or about 5 mm, less than or about 4 mm, less than or about 3 mm, less than or about 2 mm, less than or about 1 mm, less than or about 0.5 mm, or less in some embodiments.

External seal member 230 may include features to accommodate busbar 215 as well as formation processes for external seal member 230. For example, external seal member 230 may be characterized by a profile along interior surface 240 configured to accommodate components of system seal 200. In one embodiment, with some aspects as illustrated, interior surface 240 may be characterized by a slope profile extending radially outward from inner sidewall 237, which may be similar to an angle of slope of contact pins 220. As will be described below, in some embodiments, an initial portion of external seal member 230 may extend flat while an internal seal member may form the initial sloping profile of the seal member 210. Interior surface 240 may then be characterized by a reversed slope similar to contact pins 220 as the pins extend back towards busbar 215.

As external seal member 230 extends past a neck 219 portion of busbar 215 to the lateral base 216, the interior surface 240 of external seal member 230 may extend vertically towards a recessed ledge formed by busbar 215 between the neck 219 portion and the base 216 portion. The interior surface of external seal member 230 may extend radially outward in a parallel, or also in a relatively lateral direction, past outer sidewall 217 of busbar 215. A channel may be formed within such a midsection of the external seal member as will be explained further below, and partitions 245 may extend across or intersect the channel at radial locations about the channel. External seal member 230 may then extend vertically past busbar 215 and continue to extend past a height commensurate with backing plate 205. Because external seal member 230 may extend vertically beyond the conductive and other seal components, external seal member 230 may ensure that electrolyte cannot contact these components during plating operations.

Figure 3:
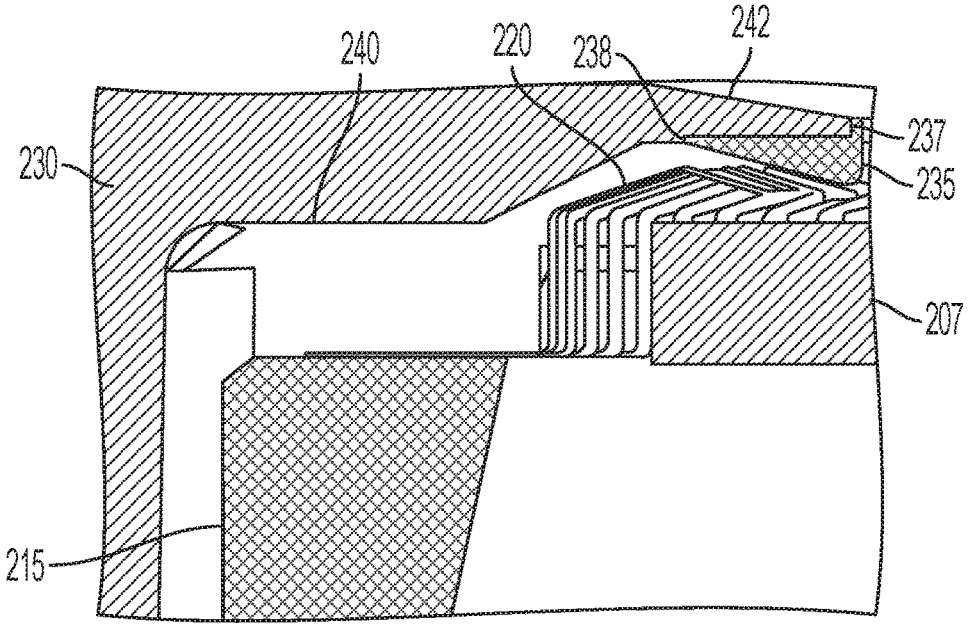
FIG. 3 shows a partial cross-sectional schematic view of an electroplating system seal according to some embodiments of the present technology.

Internal seal member 235 may be coupled with an interior portion of external seal member 230 proximate inner sidewall 237. FIG. 3 shows a detailed partial cross-sectional schematic view of an electroplating system seal 200 according to some embodiments of the present technology. System seal 200 may include some or all of the previously described components including a portion 207 of a backing plate described above, and on which a substrate may be at least partially supported. Busbar 215 may support contact pins 220 from a neck portion of busbar 215, which may be positioned within a volume defined by external seal member 230. External seal member 230 may include an interior surface 240 and an exterior surface 242 as previously described. Internal seal member 235 may be coupled with external seal member 230 proximate inner sidewall 237 of external seal member 230. Internal seal member 235 may be positioned between a radially inward most portion of external seal member 230 and contact pins 220. Internal seal member 235 may extend partially along interior surface 240 of external seal member 230 from inner sidewall 237 along a first distance, which may be less than or about 3 cm, and in some embodiments may be less than or about 2 cm, less than or about 1 cm, less than or about 9 mm, less than or about 8 mm, less than or about 7 mm less than or about 6 mm, less than or about 5 mm, less than or about 4 mm, less than or about 3 mm, less than or about 2 mm, or less.

As illustrated, internal seal member 235 may be characterized by a taper extending from inner sidewall 237. The angle of taper may be less than or about an angle of an end portion of contact pins 220. Because of this formation, in some embodiments interior surface 240 of external seal member 230 may extend laterally from inner sidewall 237, and may not be characterized by a slope where internal seal member 235 may be located. Additionally, a recessed ledge 238 may be formed in external seal member 230 at an edge of the coupling position. Interior surface 240 of external seal member 230 may continue laterally, or may continue a slope formed radially inwardly by internal seal member 235. The slope may continue to a position configured to maintain a gap spacing to support a substrate against a zenith formed by contact pins 220. For example, contact pins 220 may include a bent structure characterized by a zenith position against which a substrate may be positioned. An outer radial edge of the substrate may extend slightly beyond the contact pin, and external seal member 230 may maintain a gap spacing to accommodate the substrate that may be slightly radially outward of the highest position of the contact pins 220.

The internal seal member may be or include a deformable or compressible material, and may be configured to support a substrate between the internal seal member and the plurality of contact pins 220. In compression or deformation, the internal seal member may form a substantially, essentially, or otherwise complete seal between the internal seal member 235 and a supported substrate, which may ensure electrolyte fluid may not flow within system seal 200, or interact with contact pins 220, busbar 215, or other internal components of the head assembly on which system seal 200 may reside.

As illustrated, in some embodiments internal seal member 235 may extend radially inward of the external seal member 230. The internal seal member 235 may also extend vertically along inner sidewall 237, and may extend along a full height of inner sidewall 237 in embodiments. Although in some embodiments internal seal member 235 may extend along exterior surface 242 of external seal member 230, in some embodiments the external seal member may be maintained substantially free of the internal seal member material along the exterior surface of the external seal member 230.

As previously explained, in some embodiments external seal member 230 may include a molded component. Unlike some of the conventional materials previously described that may be machined to strict tolerances, molded materials may be susceptible to formation at tolerances that may be less than ideal. At the inner annular radius of the external seal member 230, a thickness of the material may less than or about a few millimeters, while a diameter across the external seal member may be up to 300 mm or more depending on the substrate size to be processed. Accordingly, maintaining a 10% tolerance along the entire circumference may be difficult to reproduce consistently.

In some embodiments internal seal member 235 may be a polymeric material as well and may also be molded about external seal member 230. The mold for internal seal member 235 may be formed to intended tolerances. Accordingly, in some embodiments external seal member 230 may be formed slightly narrower than an intended internal radius, and the difference may be accommodated by internal seal member 235. Accordingly, specific tolerances may be afforded by a mold for internal seal member 235, and tolerances of +/−0.5 mm, 0.4 mm, 0.3 mm, 0.2 mm, 0.1 mm, or less may be produced by defining an internal radius of seal member 210 by the internal seal member 235 alone. Some traditional materials may be limited by other issues in combining the materials along a relatively short span like inner sidewall 237. However, the present technology may overcome these issues by utilizing specific materials in the formation.

In some embodiments both external seal member 230 and internal seal member 235 may be or include polymeric materials. In some embodiments, external seal member 230 may be a thermoplastic polymer, and internal seal member 235 may be a thermoplastic elastomer. By utilizing such materials, a bonded structure may be formed. As previously explained, fluoroelastomers may often be used in components that contact a substrate, similar to the internal seal member of the present technology. The fluoroelastomers may not readily bond with the structural member of the seal, and thus an adhesive or other coupling mechanism may be employed. In some embodiments of the present technology the internal seal member 235 and/or the external seal member 230 may be free of fluorine, and the internal seal member 235 may be configured specifically to bond with external seal member 230 during formation of the seal member 210.

External seal member 230 may include a polymeric material, and may include an organic repeating moiety that may include or consist of carbon and hydrogen. Some materials that may be used in the external seal member 230 may include polyethylene, polypropylene, polybutylene, polystyrene, or other polymeric components including thermoplastic polymeric materials. To add structural rigidity, the external seal member 230 may include a filler material. The filler material may be selected to be inert to electrolyte materials used in plating operations, and the filler material may also be insulative to limit conductivity to the seal, which may otherwise result in plating on the external seal member 230. Although any such compatible filler material may be included, in some embodiments the filler material may be or include glass, which may form a glass-filled polymeric material, such as glass-filled polypropylene, as one non-limiting example. The glass content may be adjusted to regulate shrinkage and rigidity, and in embodiments the glass content may be between about 10% and about 70%, and may be between about 20% and about 60%, or between about 30% and about 50%.

Internal seal member 235 may also include a polymeric material, and may include any of the polymeric materials noted above. In some embodiments, internal seal member 235 may be or include a thermoplastic elastomer. Exemplary materials may include polyolefin thermoplastic elastomers, and may include materials incorporating rubbers, including ethylene propylene diene monomer, as one non-limiting example. Thermoplastic vulcanizate may be used as the internal seal member 235 in some embodiments as well as styrene ethylene butylene styrene. In some embodiments the molding of the internal seal member 235 to the interior surface of the external seal member 230 may be performed at a temperature configured to produce an interphase of the external seal member material and the internal seal member material. For example, polypropylene from the glass-filled polypropylene may be characterized by solubility with materials of the inner seal member, such as additional polypropylene when thermoplastic vulcanizate may be used. By forming an interphase of the components, a bond may be formed which may obviate an adhesive used in many conventional materials. Accordingly, an adhesive-free seal member 210 may be formed in some embodiments.

The external seal member 230 and the internal seal member 235 may each be characterized by a hardness. For example, external seal member 230 may be characterized by a greater hardness to provide structural rigidity and support, while internal seal member 235 may be characterized by a lower hardness to allow a seal to be formed about a substrate included within the seal. For example, the internal seal member may be characterized by a hardness on the Shore A scale of between about 10 and about 80. In some embodiments the internal seal member may be characterized by a hardness of between about 30A and about 70A, between about 40A and about 65A, between about 50A and about 65A, as well as within any lesser range included within these ranges.

Figure 4:
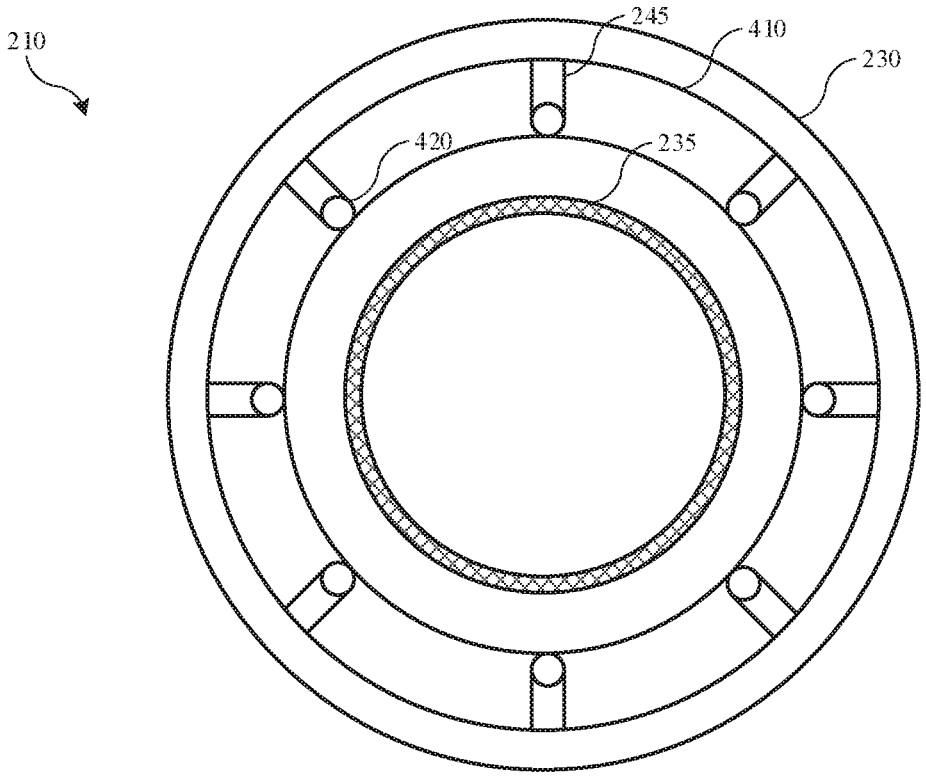
FIG. 4 shows a schematic bottom plan view of an electroplating system seal according to some embodiments of the present technology.

FIG. 4 shows a schematic bottom plan view of an electroplating seal member 210 according to some embodiments of the present technology. Seal member 210 may include any of the components previously described, and may illustrate a view with busbar 215 removed. Seal member 210 may illustrate a view of external seal member 230 and internal seal member 235. As noted previously, a channel 410 may be formed radially along a midsection of external seal member 230, such as along a location where external seal member 230 extends vertically towards a base of a busbar, which may have transitioned from a neck region. This may cause increased thickness through the midsection. Forming channel 410 may maintain a more controlled thickness across the external seal member.

As discussed above, external seal member 230 may be an injection molded part. Accordingly, larger thickness variations across a part may be difficult to accommodate during formation. Defining a channel within the part may facilitate the molding operation and increase uniformity of production of the external seal member. However, to maintain increased rigidity or structural integrity, partitions 245 may be formed at locations about the channel and may fully intersect channel 410. Any number of partitions may be included in various designs depending on the size of the component, and material used, for example. The partitions may also support recesses 420, which may be configured to receive bolts or other mechanical fasteners allowing the busbar to be coupled with the seal member 210. The recesses 420 may include threaded sleeves inserted within the recesses and allowing a threaded fastener to be utilized to couple the components.

Figure 5:
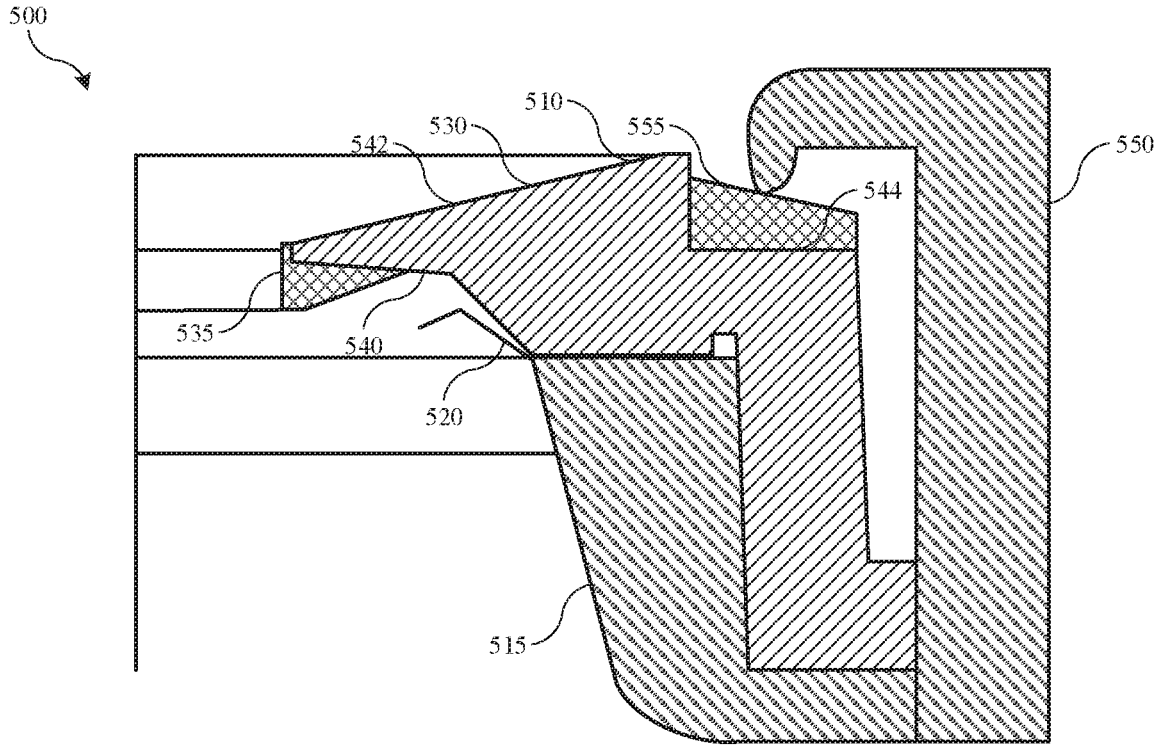
FIG. 5 shows a partial cross-sectional schematic view of an electroplating system seal according to some embodiments of the present technology.

Turning to FIG. 5 is shown a partial cross-sectional schematic view of an electroplating system seal 500 according to some embodiments of the present technology. System seal 500 may be similar to system seal 200 previously described and may include any of the components, materials, or characteristics described above. System seal 500 may also illustrate a seal that may be incorporated in systems having an additional or external retaining member. System seal 200 may illustrate a single seal design in which external seal member 230 fully encompassed or extended about busbar 215. Accordingly, the location for electrolyte ingress where a seal may be maintained was at the substrate, and with internal seal member 235. In other designs an external seal member may not extend about an associated busbar, such as illustrated in FIG. 5. Accordingly, an additional seal location may be incorporated in the design.

As noted system seal 500 may include similar components as described previously, and may include a seal member 510 and a busbar 515. Contact pins 520 may extend from an upper surface of busbar 515. Seal member 510 may include an external seal member 530 and an internal seal member 535 as previously described. In some embodiments seal member 510 may not extend radially outward of and about busbar 515. Accordingly, an outer radial edge of busbar 515 may be potentially exposed to electrolyte during plating operations. An external retaining member 550 may be included to provide an additional seal against electrolyte contact with busbar 515.

External retaining member 550 may be made of a number of materials compatible with electrolytes used in electroplating operations, and may be insulative as previously described. External retaining member 550 may be any of the materials noted above. To form a seal to protect an outer edge of busbar 515, a similar sealing material may be used at an exterior location as at the interior location where a substrate may be positioned. As illustrated, material 555 may be disposed on external seal member 530 to provide a seal location for external retaining member 550. External seal member 530 may include an interior surface 540 along which internal seal member 535 may be at least partially located. External seal member 530 may also include an exterior surface 542. The external seal member 530 may define a recessed ledge 544 along the exterior surface. An amount of material 555 may be formed or disposed within the recessed location and configured to form a liquid seal with external retaining member 550. Material 555 may be the same or a different material as used in internal seal member 535, and may be any of the previously described materials. When similar to the material for internal seal member 535, material 555 may similarly be formed to provide an adhesive-free coupling between the material 555 and the external seal member 530.

The present technology utilizes lower cost materials compared to many conventional designs for electroplating seal components. Materials according to the present technology may advantageously promote bonding between the materials, obviating the use of an adhesive to couple the materials. The bonding formed at molding temperatures of the internal seal member may provide complete and uniform bonding of the components, increasing sealing capabilities of the apparatus. The unique profile of the internal seal member additionally reduces tolerance issues for the external seal member by allowing a consistent inner diameter for the seal to be produced.

In the preceding description, for the purposes of explanation, numerous details have been set forth in order to provide an understanding of various embodiments of the present technology. It will be apparent to one skilled in the art, however, that certain embodiments may be practiced without some of these details, or with additional details. For example, other substrates that may benefit from the wetting techniques described may also be used with the present technology.

Having disclosed several embodiments, it will be recognized by those of skill in the art that various modifications, alternative constructions, and equivalents may be used without departing from the spirit of the embodiments. Additionally, a number of well-known processes and elements have not been described in order to avoid unnecessarily obscuring the present technology. Accordingly, the above description should not be taken as limiting the scope of the technology.

Where a range of values is provided, it is understood that each intervening value, to the smallest fraction of the unit of the lower limit, unless the context clearly dictates otherwise, between the upper and lower limits of that range is also specifically disclosed. Any narrower range between any stated values or unstated intervening values in a stated range and any other stated or intervening value in that stated range is encompassed. The upper and lower limits of those smaller ranges may independently be included or excluded in the range, and each range where either, neither, or both limits are included in the smaller ranges is also encompassed within the technology, subject to any specifically excluded limit in the stated range. Where the stated range includes one or both of the limits, ranges excluding either or both of those included limits are also included. Where multiple values are provided in a list, any range encompassing or based on any of those values is similarly specifically disclosed.

As used herein and in the appended claims, the singular forms "a", "an", and "the" include plural references unless the context clearly dictates otherwise. Thus, for example, reference to "a material" includes a plurality of such materials, and reference to "the channel" includes reference to one or more channels and equivalents thereof known to those skilled in the art, and so forth.

Also, the words "comprise(s)", "comprising", "contain(s)", "containing", "include(s)", and "including", when used in this specification and in the following claims, are intended to specify the presence of stated features, integers, components, or operations, but they do not preclude the presence or addition of one or more other features, integers, components, operations, acts, or groups.

What is claimed is:

1. An electroplating system comprising:

an annular busbar comprising an inner annular radius and an outer annular radius, wherein the annular busbar comprises a plurality of contact extensions disposed along the inner annular radius;

an external seal member comprising an inner annular radius and an outer annular radius, wherein the external seal member is vertically aligned with an extends inward of the contact extensions at the inner annular radius of the external seal member, wherein the external seal member comprises an interior surface at least partially facing the contact extensions, an exterior surface opposite the interior surface, and an inner sidewall extending between the interior surface and the exterior surface at the inner annular radius, and wherein the external seal member comprises a glass-filled polypropylene; and an internal seal member extending in contact with the external seal member a first distance along the interior surface of the external seal member from the inner annular radius, wherein the internal seal member comprises a deformable material configured to support a substrate between the internal seal member and the plurality of contact extensions and wherein the internal seal member comprises thermoplastic vulcanizate or styrene ethylene butylene styrene.

2. The electroplating system of claim 1, wherein an interface of the external seal member and the internal seal member comprises a preformed interphase.

3. The electroplating system claim 1, wherein the internal seal member extends inward of the external seal member, and wherein the internal seal member extends vertically along the inner sidewall of the external seal member at the inner annular radius of the external seal member.

4. The electroplating system of claim 1, wherein the external seal member is maintained substantially free of the internal seal member along the exterior surface of the external seal member.

5. The electroplating system of claim 1, wherein the external seal member defines a recessed ledge along the exterior surface between the inner annular radius and the outer annular radius of the external seal member, and wherein an additional amount of the deformable material of the internal seal member is positioned along the recessed ledge.

6. An electroplating system seal comprising:

an external seal member comprising an inner annular radius and an outer annular radius, wherein the external seal member comprises an interior surface, an exterior surface opposite the interior surface, and an inner sidewall extending between the interior surface and the exterior surface at the inner annular radius, and wherein the external seal member comprises a glass-filled polypropylene; and an internal seal member extending a first distance along the interior surface of the external seal member from the inner annular radius, wherein an interface between the internal seal member and the external seal member comprises an adhesive-free coupling between the external seal member and the internal seal member, wherein the internal seal member extends inward of the external seal member, wherein the internal seal member extends vertically along the inner sidewall of the external seal member at the inner annular radius of the external seal member, wherein the internal seal member extends in contact with the inner sidewall of the external seal member at the inner annular radius of the external seal member, and wherein the internal seal member comprises thermoplastic vulcanizate or styrene ethylene butylene styrene.

7. The electroplating system seal of claim 6, wherein an interface of the external seal member and the internal seal member comprises a preformed interphase of the external seal member and the internal seal member.

8. The electroplating system seal of claim 6, wherein the external seal member is maintained substantially free of the internal seal member along the exterior surface of the external seal member.

9. The electroplating system seal of claim 6, wherein the external seal member defines a recessed ledge along the exterior surface between the inner annular radius and the outer annular radius of the external seal member, and wherein an additional amount of material of the internal seal member is positioned along the recessed ledge.

10. The electroplating system seal of claim 6, wherein the internal seal member comprises a taper of material from the inner annular radius of the external seal member along the interior surface of the external seal member.

11. The electroplating system seal of claim 6, wherein the external seal member defines a partitioned channel extending radially about the external seal member and defined within the interior surface between the inner annular radius and the outer annular radius of the external seal member.

12. The electroplating system seal of claim 6, wherein the internal seal member is characterized by a Shore A hardness of between about 30A and about 80A.

13. An electroplating system comprising:

an annular busbar comprising an inner annular radius and an outer annular radius, wherein the annular busbar comprises a plurality of contact extensions disposed along the inner annular radius, and wherein the annular busbar comprises an outer sidewall at the outer annular radius;

an external seal member comprising an inner annular radius and an outer annular radius, wherein the external seal member comprises a glass-filled polypropylene, wherein a portion of the external seal member is vertically aligned with and extends inward of the contact extensions at the inner annular radius of the external seal member, wherein the external seal member comprises an interior surface at least partially facing the contact extensions, an exterior surface opposite the interior surface, and an inner sidewall extending between the interior surface and the exterior surface at the inner annular radius, and wherein the external seal member extends outward of the annular busbar at the outer annular radius of the external seal member and vertically along the outer sidewall of the annular busbar; and an internal seal member extending in contact with the external seal member a first distance along the interior surface of the external seal member from the inner annular radius, wherein the internal seal member comprises thermoplastic vulcanizate or styrene ethylene butylene styrene, and wherein the internal seal member is configured to support a substrate between the internal seal member and the plurality of contact extensions.

14. The electroplating system of claim 13, wherein the external seal member defines a recessed ledge along the exterior surface between the inner annular radius and the outer annular radius of the external seal member, and wherein an additional amount of thermoplastic vulcanizate or styrene ethylene butylene styrene is positioned along the recessed ledge.

* * * * *